US006724138B2

(12) United States Patent
Nakase et al.

(10) Patent No.: US 6,724,138 B2
(45) Date of Patent: Apr. 20, 2004

(54) CATHODE RAY TUBE WITH SHADOW MASK FRAME

(75) Inventors: Kiyotaka Nakase, Ibarak (JP); Yuichi Kimura, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 65 days.

(21) Appl. No.: 10/091,622

(22) Filed: Mar. 5, 2002

(65) Prior Publication Data

US 2002/0158563 A1 Oct. 31, 2002

(30) Foreign Application Priority Data

Mar. 8, 2001 (JP) ..... 2001-064608

(51) Int. Cl.[7] ..... H01J 29/80
(52) U.S. Cl. ..... 313/407; 313/402; 313/404
(58) Field of Search ..... 313/404, 402, 313/407

(56) References Cited

U.S. PATENT DOCUMENTS 5,672,935 A * 9/1997 Ito et al. ..... 313/406
6,188,170 B1 * 2/2001 Shimizu et al. ..... 313/407
6,310,433 B1 * 10/2001 Youn et al. ..... 313/402
6,501,214 B1 * 12/2002 Sakamoto et al. ..... 313/407
6,566,798 B2 * 5/2003 Watanabe et al. ..... 313/407
2002/0024282 A1 * 2/2002 Tani et al. ..... 313/407

FOREIGN PATENT DOCUMENTS

JP 2002-260550 * 9/2002 ..... H01J/29/07

OTHER PUBLICATIONS

"Corner Lock Suspension," Donofrio, Robert L., Information Display, Nov. 1995.

* cited by examiner

*Primary Examiner*—Nimeshkumar D. Patel
*Assistant Examiner*—Holly Harper
(74) *Attorney, Agent, or Firm*—Merchant & Gould, P.C.

(57) ABSTRACT

The present invention provides a color cathode ray including a pair of long frames, a pair of opposing short frames that are fixed to the pair of long frames and support the long frames, and a shadow mask fixed to the pair of long frames in a state applied with a tensile force. The short frames have substantially-triangular bent parts formed to protrude toward the shadow mask. Since such a cathode ray tube can decrease an internal moment of the shadow mask structure, the displacement of the shadow mask in a direction to recede from the phosphor screen surface of the color cathode ray tube can be suppressed and the q-value deviation also can be suppressed even if the shadow mask is expanded by heat generated by an impact of electron beams.

8 Claims, 7 Drawing Sheets

CATHODE RAY TUBE WITH SHADOW MASK FRAME

BACKGROUND OF THE INVENTION

1. Field of the Invention

The present invention relates to a shadow mask type color cathode ray tube used for a television receiver, a computer display, and the like.

2. Description of the Related Art

FIG. 8 is a cross-sectional view showing one example of a conventional color cathode ray tube. The color cathode ray tube 1*a* in FIG. 8 includes a substantially rectangular-shaped face panel 2 having a phosphor screen 2*a* formed on its inner surface, a funnel 3 connected to the rear side of the face panel 2, an electron gun 4 contained in a neck portion 3*a* of the funnel 3, a shadow mask 6 facing the phosphor screen 2*a* inside the face panel 2, and a long frame 7 for fixing the shadow mask 6. Furthermore, in order to deflect and scan electron beams, a deflection yoke 5 is provided on the outer periphery of the funnel 3.

The shadow mask 6 plays the role of selecting colors with respect to three electron beams emitted from the electron gun 4. The shadow mask 6 is a flat plate in which a number of apertures, through which electron beams pass, are formed by etching. 'A' shows a track of the electron beams.

The long frames 7 fixes the shadow mask 6, and a pair of short frames 8 are fixed to the longitudinal ends of the long frames 7. The pair of long frames 7 and the pair of short frames 8 form a frame structure. This frame structure and a shadow mask 6 fixed to the frame structure compose a shadow mask structure 9.

Plate-shaped spring-attaching members 21 are adhered to the pair of long frames 7, and spring members 10 are fixed to these spring-attaching members 21. Plate-shaped spring-attaching members 11 are adhered to the pair of short frames 8, and spring members 12 are adhered to the spring-attaching members 11.

The shadow mask structure 9 is fixed to the face panel 2 by fitting attaching holes 10*a* of the spring members 10 with pins 13 provided to the top and bottom of the inner surface of the face panel 2, and by fitting the attaching holes 12*a* of the spring members 12 with pins (not shown) provided to the right and left of the inner surface of the face panel 2.

In a color cathode ray tube, due to the thermal expansion of the shadow mask 6 caused by the impact of the emitted electron beams, the apertures for passing electron beams are displaced. Consequently, a doming phenomenon occurs. That is, the electron beams passing through the apertures fail to hit a predetermined phosphor correctly, thus causing unevenness in colors. Therefore, a tensile force to absorb the thermal expansion due to the temperature rise of the shadow mask is applied in advance, and then the shadow mask 6 is stretched and held to the long frames 7. When the shadow mask 6 is stretched and held as mentioned above, it is possible to reduce the displacement between an aperture of the shadow mask 6 and phosphor stripes of the phosphor screen 2*a* even if the temperature of the shadow mask 6 is raised.

However, the conventional color cathode ray tube described above suffered from the following problem. When an electron beam hits the stretched shadow mask 6, the shadow mask 6 is expanded by heat and its tensile force is reduced. Thereby, the internal moment of the shadow mask structure 9 changes and the balance changes as well. Due to the change in the balanced state, a distance 23 (q-value) between the apertures of the shadow mask 6 and the phosphor screen 2*a* is deviated, that is, the shadow mask 6 is displaced to recede from the phosphor screen 2*a* in the axial direction. This will prevent electron beams from hitting a desired position of the phosphor, which will lead to unevenness in colors. With respect to unevenness in colors, the displacement of the shadow mask 6 to recede from the phosphor screen 2*a* in the axial direction may be more unfavorable in general than displacement to approach the phosphor screen 2*a*.

SUMMARY OF THE INVENTION

It is an object of the present invention to provide a cathode ray tube that can solve the problems of conventional techniques. Such a cathode ray tube can suppress a shadow mask from being displaced in an axial direction with respect to a phosphor screen and can prevent unevenness in colors.

To achieve the above object, a color cathode ray of the present invention comprises a pair of long frames, a pair of opposing short frames that are fixed to the pair of long frames and support the long frames, and a shadow mask fixed in a state applied with a tensile force to the pair of long frames, wherein the short frames have substantially-triangular bent parts formed to protrude toward the shadow mask. Since such a cathode ray tube can decrease an internal moment of the shadow mask structure, the displacement of the shadow mask in a direction to recede from the phosphor screen surface of the color cathode ray tube can be suppressed and the q-value deviation also can be suppressed even if the shadow mask is expanded by heat generated by an impact of electron beams.

The substantially-triangular bent parts of the color cathode ray tube comprise neutral axes at crests protruding toward the shadow mask and the neutral axes are located above a surface of the shadow mask. Accordingly, the shadow mask approaches the phosphor screen of the color cathode ray tube when it is expanded by heat, providing effects in correcting unevenness in colors.

The substantially-triangular bent parts of the color cathode ray tube form recesses having a width dimension in a range from ⅙ to ½ of the maximum length in the longitudinal direction of the short frames. Accordingly, sufficient effects in correcting unevenness in colors will be secured, and also the productivity is improved since the color cathode ray tube is less deformed by heat in the production process and the accuracy of its q-value is stabilized.

The substantially-triangular bent parts of the color cathode ray tube may have circular corners with an outer radius of curvature of at least 15 mm. Accordingly, excessive concentration of stress at the corners can be prevented so as to secure sufficient rigidity.

Additionally, support-adjusting members are fixed to the short frames by extending across the recesses formed by the substantially-triangular bent parts. Accordingly, the change of an inner moment can be decreased, and moreover, the short frames will have improved rigidity. Since the improved rigidity serves to increase the cross-sectional second moment, the cross-section area of the steel material used for the short frames can be decreased. Displacement of the shadow mask in the axial direction with respect to the phosphor screen of the color cathode ray tube is suppressed at a time of impact of electron beams.

The support-adjusting members have a thermal expansion coefficient that is bigger than that of the short frames, which can prevent plastic deformation of the shadow mask during a heat treatment step, and also suppress displacement in the axial direction at a time of operation of the color cathode ray tube.

DETAILED DESCRIPTION OF THE INVENTION

An embodiment of the present invention will be described below with reference to the drawings. Components that are common to the conventional techniques are identified with identical numerals.

(First Embodiment)

Figure 1:
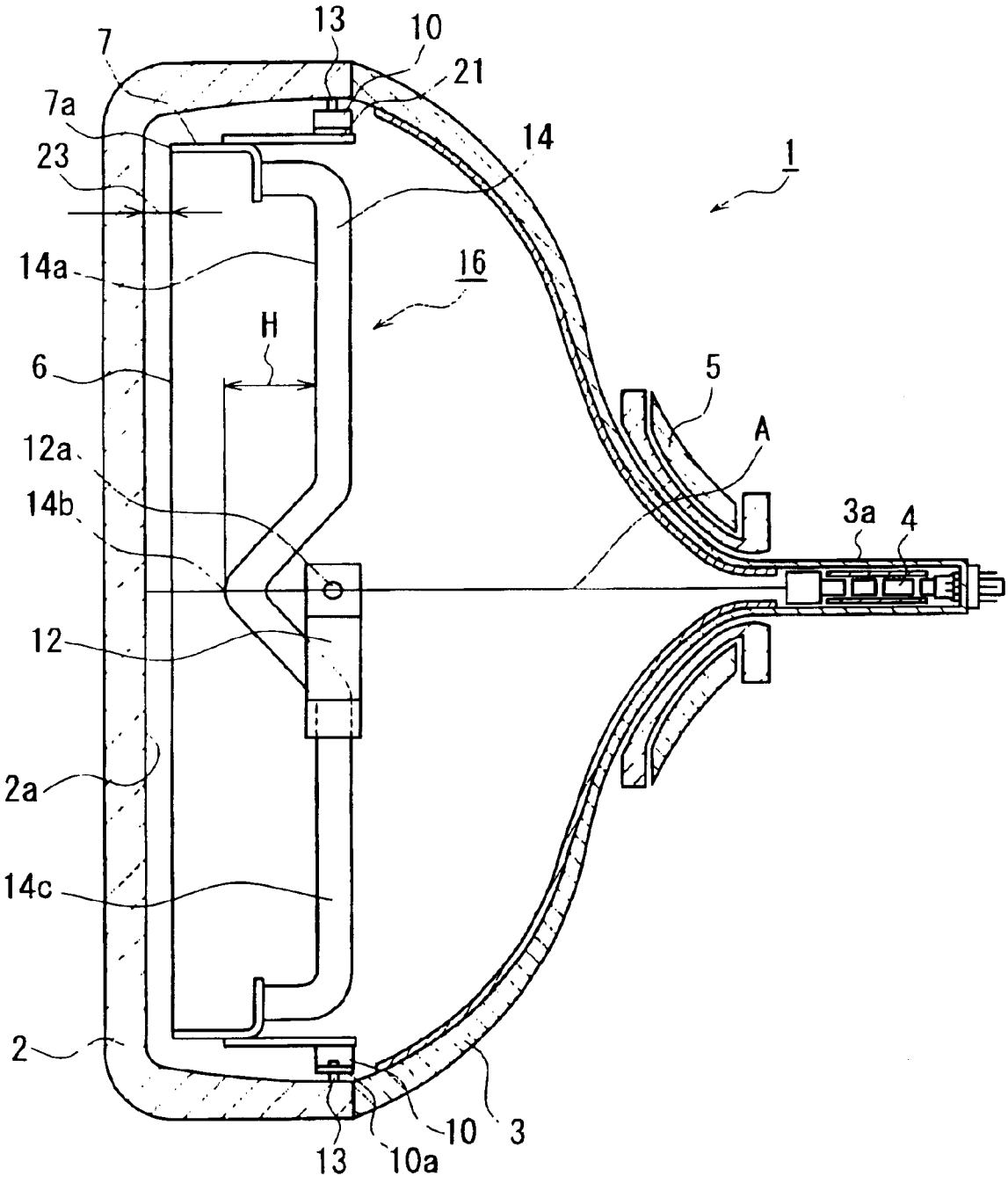
FIG. 1 is a cross-sectional view to show a color cathode ray tube in a first embodiment of the present invention.
Figure 2:
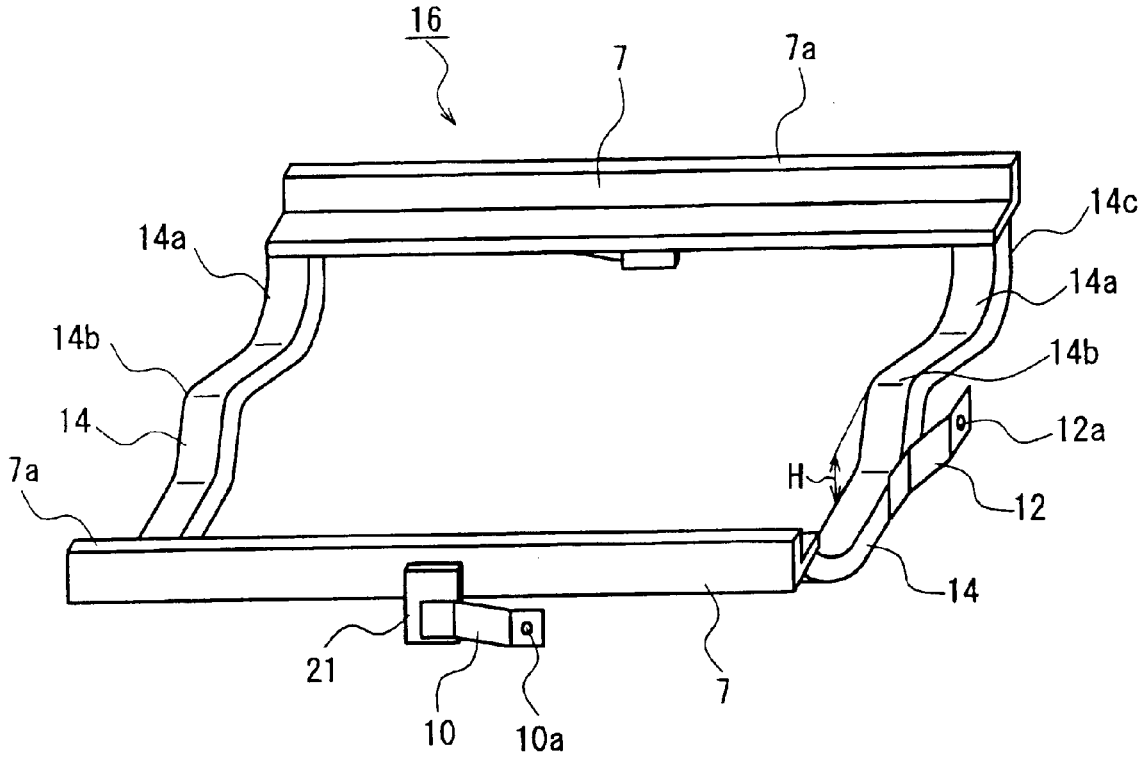
FIG. 2 is a perspective view of a shadow mask structure in the first embodiment of the present invention.

FIG. 1 is a cross-sectional view of a color cathode ray tube 1 in a first embodiment of the present invention. FIG. 2 is a perspective view of a shadow mask structure 16 of FIG. 1. A shadow mask 6 is omitted from FIG. 2.

A pair of short frames 14 are prisms having substantially square or rectangular cross sections. The short frames 14 have substantially-triangular bent parts that are formed to protrude toward the shadow mask 6. Namely, each short frame 14 has a certain bending height H between a crest 14*b* at the bent part and a surface 14*a*.

The short frames 14 are adhered respectively to the both ends of the pair of long frames 7 as plate members by means of welding or the like in order to form a frame structure (FIG. 2). The shadow mask 6 is adhered to upper surfaces 7*a* of the long frames 7 so as to form a shadow mask structure 16. Plate-shaped spring-attaching members 21 are adhered to the pair of long frames 7, and spring members 10 are fixed to the spring-attaching members 21. Spring members 12 are adhered to the pair of short frames 14. Thereby, attaching holes 12*a* formed at the spring members 12 are located at the substantial centers of the respective short frames 14 in the longitudinal direction.

Each short frame 14 of the frame structure has an outer surface 14*c* formed as one flat surface, and thus, the spring-attaching member 21 can be attached to the frame 14 easily. When the short frame 14 is made of a ferrous material, the substantially-triangular bent part of the short frame 14 will hinder passing of magnetic flux of geomagnetism in the horizontal axis direction, providing a magnetic shielding effect. Furthermore, since the bent part is a substantial triangle and the short frame is bent at only three locations, efficiency in the production process can be improved.

Figure 8:
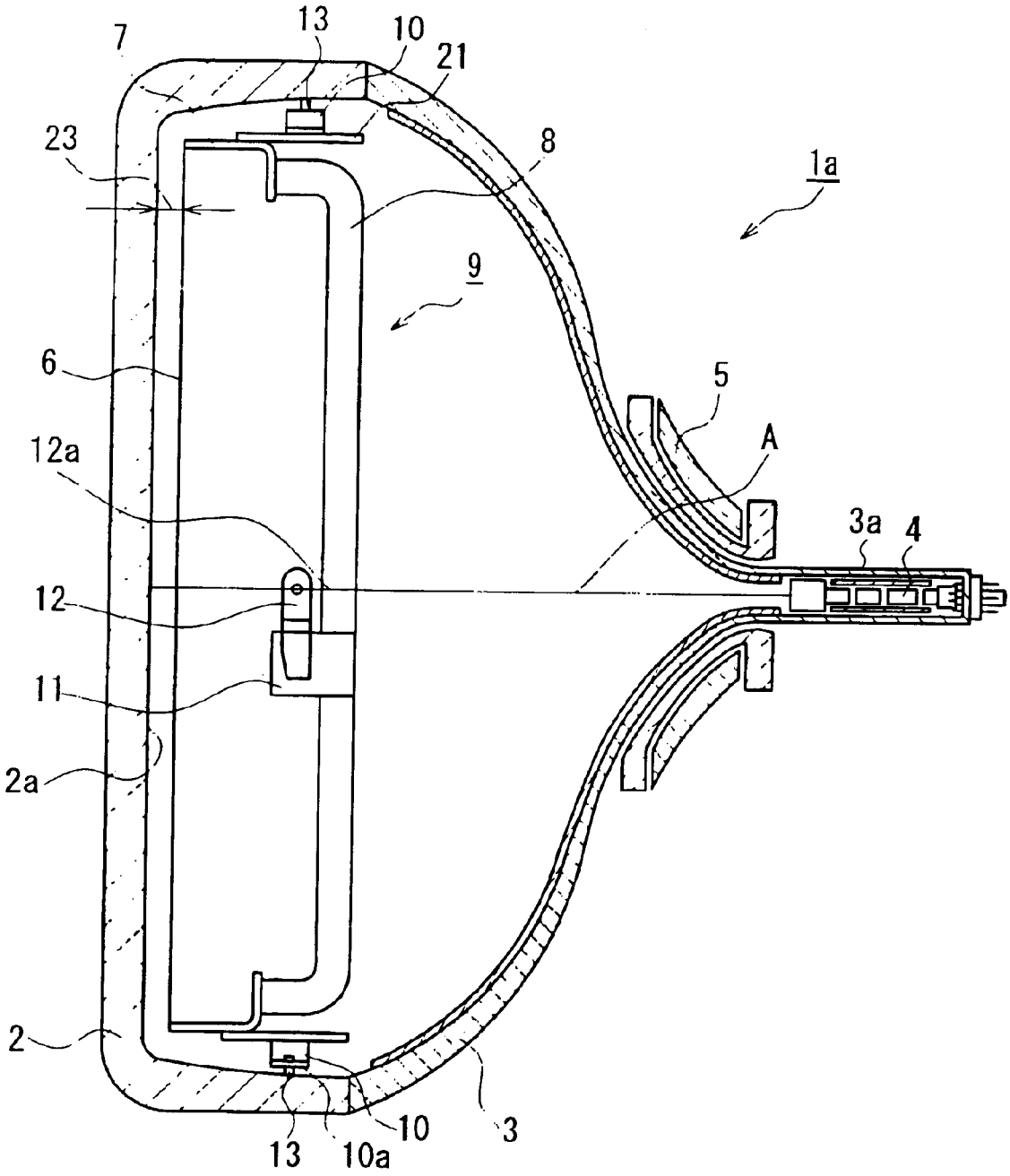
FIG. 8 PRIOR ART
FIG. 8 is a cross-sectional view of a conventional color cathode ray tube.

The shadow mask structure 16 is fixed to the face panel 2 in the same manner as shown in FIG. 8, by fitting the attaching holes 10*a* of the spring members 10 with top and bottom pins 13 on the inner surface of the face panel 2, and by fitting the attaching holes 12*a* of the spring members 12 with right and left pins (not shown) on the inner surface of the face panel 2.

Figure 3A:
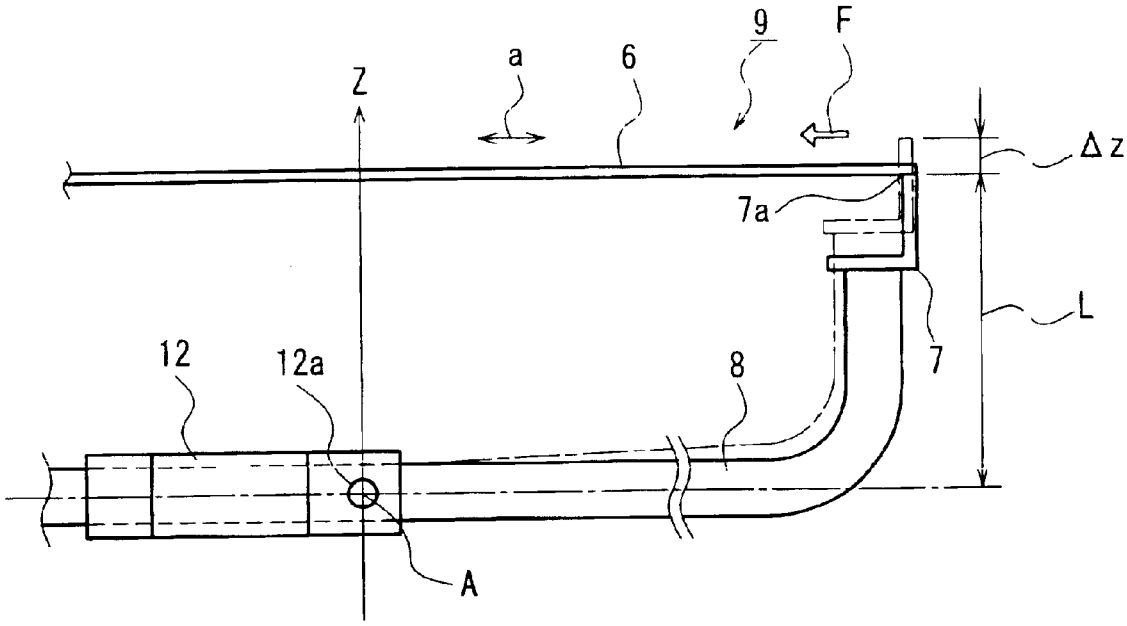
FIG. 3A PRIOR ART
FIG. 3A illustrates a conventional shadow mask structure applied with a moment.
Figure 3B:
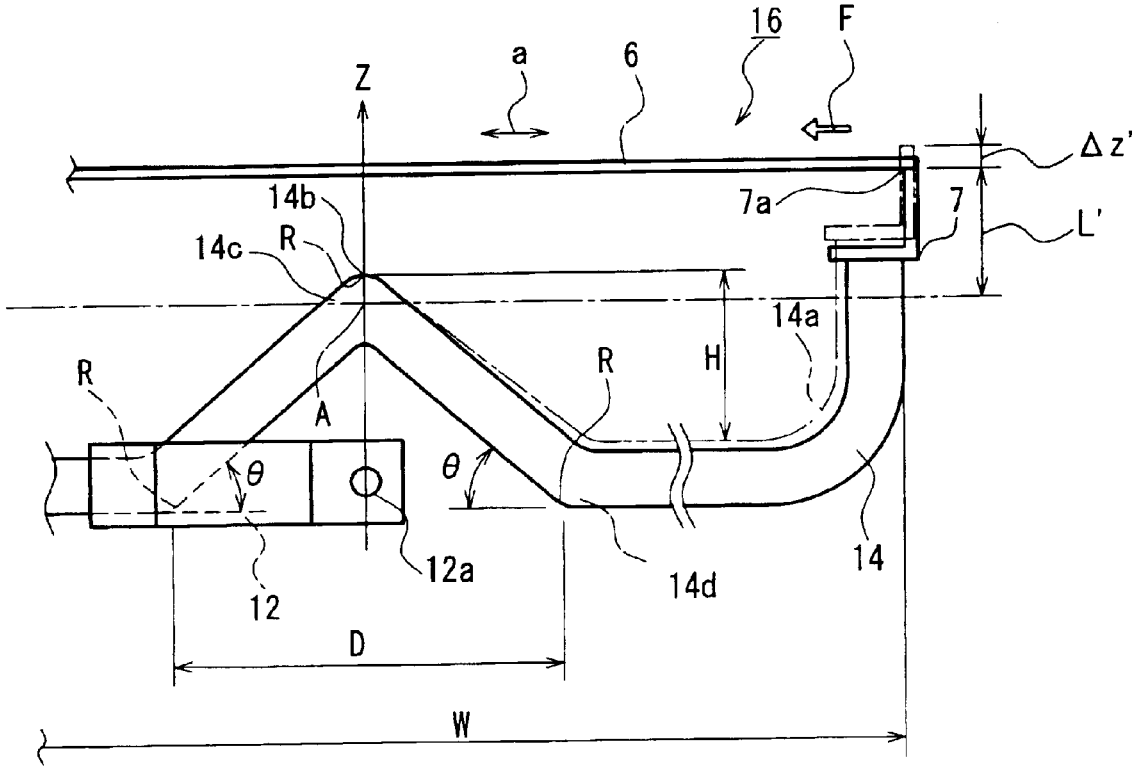
FIG. 3B illustrates a shadow mask structure in the first embodiment of the present invention, where the shadow mask structure is applied with a moment.

FIGS. 3A and 3B are partial side views of shadow mask structures to show a comparison of moments applied to the respective shadow mask structures. FIG. 3A shows a shadow mask structure of a conventional technique where the short frames have no bent parts, while FIG. 3B shows a structure of an embodiment shown in FIG. 1. In FIGS. 3A and 3B, z axis direction is equal to the axial direction, and a direction heading from the shadow mask 6 to the inner surface of the face panel 2 is determined to be a positive direction.

In either of FIGS. 3A and 3B, the shadow mask 6 is held in a state stretched over an upper surface 7*a* of the long frame 7, so that the shadow mask 6 is applied with tensile force in a direction denoted with an arrow 'a'. When the shadow mask 6 has a tensile force F, the upper surface 7*a* of the long frame 7 is subjected to a reaction force F in a direction denoted with a thick arrow (a direction in which the upper surface 7*a* is tilted inward) and the reaction force F is as large as the tensile force F. The spring member 12 comprises an ordinary spring having a thickness of about 1 mm. Consequently, a change in a moment, which is caused by thermal expansion of the shadow mask 6, will be determined depending on the respective frames (7, 14) assembled to become a frame structure.

In a conventional example shown in FIG. 3A, a relationship represented by $M=F\times L$ is established, where M denotes a moment provided by the reaction force F and moment M is about a point A as a center of moment on the neutral axis of the short frame 8, while L denotes a shortest direct distance from the upper surface 7*a* to the neutral axis. That is, in a condition as shown in FIG. 3A, the balance is kept in a state that a moment M about a point A, which is provided by the reaction force F of the upper surface 7*a* of the long frame 7, is applied.

When the shadow mask 6 is expanded by heat and the tensile force F is decreased, the moment M about the point A provided by the reaction force of the upper surface 7*a* of the long frame 7 is decreased as well, and this changes the balanced state. In a case of FIG. 3A, the tensile force F is lowered due to thermal expansion, and thus, the frame 8 shifts from a position indicated with the alternate long and short dashed line to a position indicated with a solid line, and the balance will be kept again in this state. That is, the upper surface 7*a* of the long frame 7 is displaced by $\Delta z$ in the negative direction of the z axis. Actually, since the frame 8 is bound by the attaching hole 12*a* of the spring member 12, the short frame 8 is displaced by $\Delta z$ in the negative direction of the z axis.

In FIG. 3B regarding an embodiment of the present invention, $M'=F\times L'$, where M' denotes a moment about a point A provided by the reaction force F, and L' denotes a shortest direct distance from the upper surface 7*a* to the neutral axis at the bent part 14*c* (located closer to the crest 14*b*) of the short frame 14. In this case, the crest 14*b* of the frame 14 is located in the positive direction of the z axis, i.e., at a position closer to the shadow mask 6 in a comparison between the surface 14*a* and the crest 14*b*. As a result, the point A also is displaced in the positive direction of the z axis. Therefore, the distance L' is shorter than the distance L by the distance of the bending-height H, and thus, relationships of L'<L and M'<M are established.

In FIG. 3B, the balance is kept in a state applied with a moment M' that is smaller than a moment M. When the shadow mask 6 is expanded by heat to reduce the tensile force F as in the case of FIG. 3A, the moment M' is reduced also and the balance will change. In FIG. 3B, due to the decline in the tensile force F, the frame shifts from a position indicated by an alternate long and short dashed line to a position indicated by a solid line, where the balanced state will be kept again. At this time, the bent short frame 14 indicated with a dashed line moves to be relaxed. That is, as a result of thermal expansion, the upper surface 7*a* of the long frame 7 is displaced by Δz' in the negative direction of the z axis.

The amount of displacement in the z axis direction caused by the change in the tensile force is in proportion to the moment about the point A provided by the reaction force on the upper surface 7*a* of the long frame 7, where the reaction force causes bending of the short frame 14. Since M'<M as mentioned above, a relationship Δz<A z is established. Therefore, the moment about the point A caused by the reaction force of the upper surface 7*a* of the long frame 7 can be reduced according to the present embodiment, the degree of the bending in the frame 14 can be decreased and the displacement amount of the upper surface 7*a* of the long frame 7 in the z axis direction can be decreased as well. That is, even when the shadow mask 6 is expanded by heat generated by the impact of electron beams, displacement of the shadow mask 6 in the axial direction (z axis direction) can be suppressed and q-value deviation can be suppressed.

The short frame 14 shown in FIG. 3B is subject to compression at a time of holding the shadow mask to be stretched, and thus, a moment about the point A will be applied as well after keeping the stretched state. Therefore, it is useful for the frame 14 to have a certain rigidity to be resistant to plastic deformation. For satisfying the requirement, the circular bent parts 14*c* and 14*d* at the substantially-triangular portion are preferred to have an outer radius (R) of curvature of at least 15 mm, and more preferably, at least 30 mm. The same condition can be applied to the following second, third and fourth embodiments shown in FIGS. 5, 6 and 7.

Effects of the present invention are described below.

The following Table 1 shows the results of a test to compare the movement amount of electron beams at a time of irradiation of electron beams. The test was performed by using a shadow mask structure of FIG. 1 and a conventional shadow mask structure of FIG. 8.

TABLE 1

| | EW ends | Corners |
|---|---|---|
| Conventional structure shown in FIG. 8 | Outward 10 μm | Outward 25 μm |
| Claimed structure shown in FIG. 1 | Outward 5 μm | Outward 10 μm |

Table 1 relates to a result of a test in which the entire shadow mask is irradiated with electron beams. 'EW end' in Table 1 denotes the right and left ends of the shadow mask while being on a horizontal axis perpendicularly crossing the tube axis. The right end is an E end and the left end is a W end when viewed from the surface of the shadow mask. The term 'outward' means that the electron beams moved outward (right to left) on the phosphor surface. The level of the electron beam was as follows: Ia=1650 μA.

Electron beams will move outward on the phosphor surface as the shadow mask is displaced further in the negative axial direction (a direction for leaving from the phosphor surface). In the test results shown in Table 1, the outward movement amount of the electron beams is decreased remarkably when compared to a conventional technique. This indicates that the displacement of the shadow mask in the axial direction is decreased remarkably.

Figure 4A:
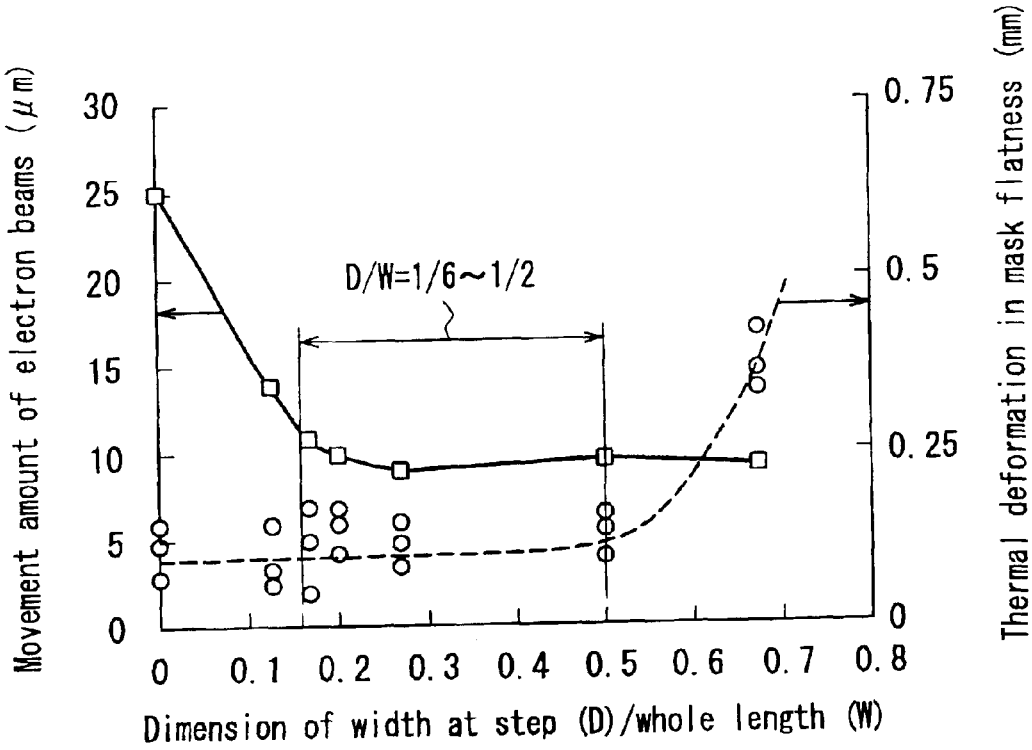
FIG. 4A is a graph to show a relationship between a movement amount of electron beams with respect to a substantially-triangular bent part and a thermal deformation in flatness of a mask during a production process in the first embodiment.

FIG. 4A is a graph to show a test result regarding a relationship between a movement amount of electron beams at a time of thermal expansion of a shadow mask and a thermal deformation in flatness of a mask during a production process (degradation in the flatness) when a ratio of D/W of a color cathode ray tube in the first embodiment of the present invention shown in FIGS. 1 and 3B is changed. In the test, the bending height H is fixed at about 14.5 mm. Here, W denotes a maximum length of a short frame 14 in the longitudinal direction while D denotes a maximum dimension in width of a recess formed by the substantially-triangular bent part. A mask flatness is obtained from a measurement of displacement of one point at a corner of the mask structure with respect to a flat surface defined by three points at the remaining three corners of the same mask structure.

FIG. 4A indicates that D/W in a range of ⅙–½ serves to suppress the movement amount of electron beams to 12 μm or less, which can suppress unevenness in colors, and also decrease thermal deformation of the flatness of mask in the production process to 150 μm or less.

Figure 4B:
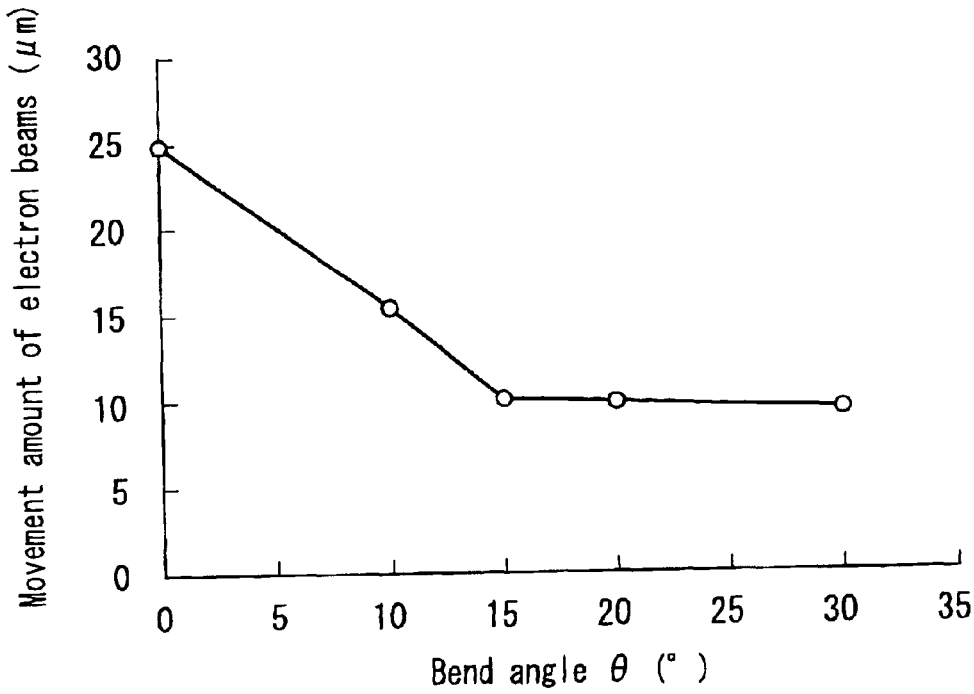
FIG. 4B is a graph to show a relationship between a bend angle θ of the substantially-triangular bent part and a movement amount of electron beams of the shadow mask structure.

FIG. 4B indicates a test result regarding a movement amount of electron beams at a time of thermal expansion of a shadow mask, when D/W is fixed at ⅕ while a bend angle θ is varied.

FIG. 4B shows that the movement amount of electron beams can be controlled to 12 μm or less when the bend angle θ is at least 15°, and thus, unevenness in colors can be suppressed.

Therefore, the accuracy of a q-value is improved in the entire area of a screen when D/W is in a range of ⅙–½ an where the bend angle θ is at least 15°. Moreover, since the accuracy of the q-value is stabilized, the productivity also is improved.

(Second Embodiment)

In the first embodiment shown in FIG. 3B, the crest 14*b* of the short frame 14 is displaced in the positive direction of the z axis with respect to the surface 14*a*, while the crest 14*b* does not reach a surface of the shadow mask 6. In an embodiment shown in FIG. 5, a bending height Ha between a surface 20*a* and a crest 20*b* of a short frame 20 is bigger than the bending height H shown in FIG. 3B. The crest 20*b* is displaced further in the positive direction of the z axis, and the neutral axis of the crest 20*b* is located above the surface of the shadow mask 6.

In the second embodiment, the point A as a center on the neutral axis of the frame 20 is located above the surface of the shadow mask 6, unlike the first embodiment shown in FIG. 3B. Therefore, the moment M direction about the point A is reversed. As a result, the direction of displacement of the upper surface 7*a* of the long frame 7, which is caused by thermal expansion in the shadow mask 6, is also reversed (positive direction of the z axis).

Consequently, the thermally expanded shadow mask 6 is displaced to approach the phosphor screen surface 2*a*. The displacement of the shadow mask 6 serves to correct fluctuations of electron beam tracks caused by outward displacement of the apertures due to the thermal expansion, providing an effect in correcting unevenness in colors.

(Third Embodiment)

Figure 6:
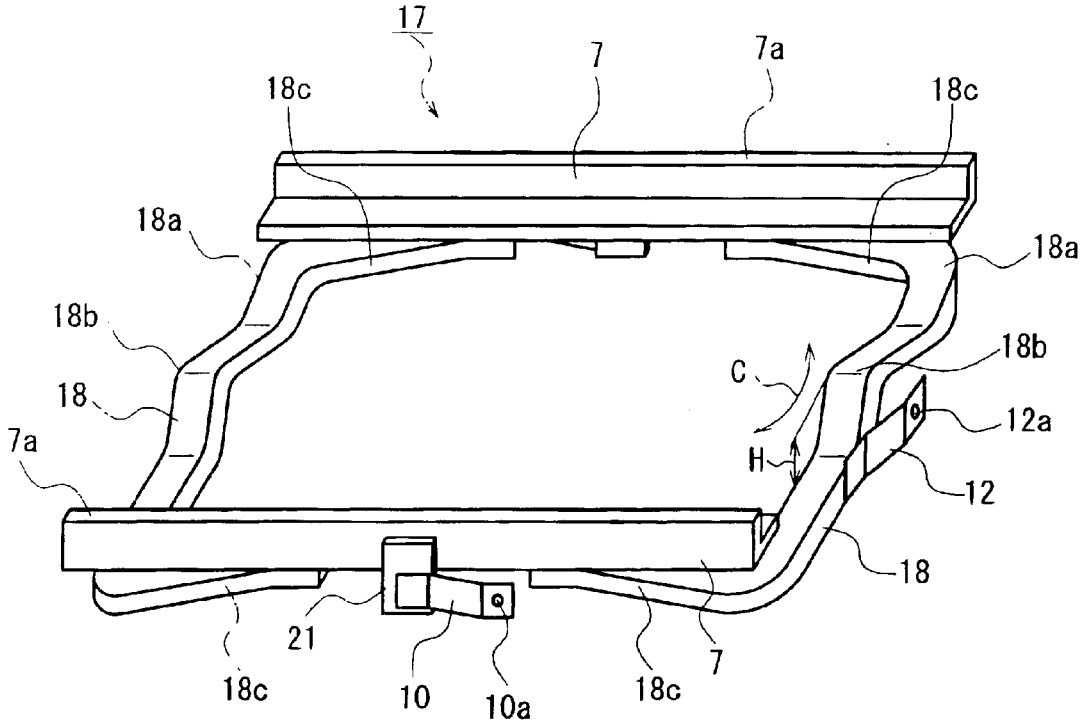
FIG. 6 is a perspective view of a shadow mask structure in a third embodiment of the present invention.

FIG. 6 shows a shadow mask structure according to a third embodiment. In FIG. 6, a shadow mask 6 is not shown. Similar to the frame structure of the first embodiment shown in FIG. 2, a shadow mask structure 17 comprises a pair of prismatic short frames 18 having substantially-triangular bent parts that are formed to protrude toward the shadow mask 6. Namely, each short frame 18 has a certain bending height H between a crest 18*b* at the bent part and a surface 18*a*.

Short frames 18 have portions 18*c* extended from both ends to the insides of the long frames 7 in the longitudinal direction. The extended portions 18*c* are adhered at the ends to the long frames 7, so that the ends of the extended portions 18*c* reach the insides of the long frames 7 in the longitudinal direction so as to be adhered by welding or the like. Therefore, there are gaps between the long frames 7 and the short frames 18 as supporters at both ends of the long frames 7.

Similar to the first embodiment shown in FIG. 2, the frame structure shown in FIG. 6 can decrease a moment about the point A caused by the reaction force of the upper surface 7*a* of each long frame 7, and decrease bending and deformation of the short frames 18. Even when the shadow mask 6 is expanded by heat, it is possible to suppress the displacement of the shadow mask 6 in the axial direction, and also suppress the q-value deviation.

By using the shadow mask structure 17 as shown in FIG. 6, the tensile force of the shadow mask 6 in the longitudinal direction of the long frames 7 can be distributed in a mountain form, i.e., the tensile force distribution is greater in the middle than at both ends, so that vibration of the shadow mask 6 can be suppressed easily at the free ends of the shadow mask 6. When thermal expansion in the shadow mask 6 decreases the tensile force, more stress is absorbed at the extended portion 18*c* of the short frame 18 when compared with the case of the shadow mask structure 16 in the first embodiment shown in FIG. 2. As a result, the moment about point A can be decreased further in the third embodiment.

(Fourth Embodiment)

Figure 7:
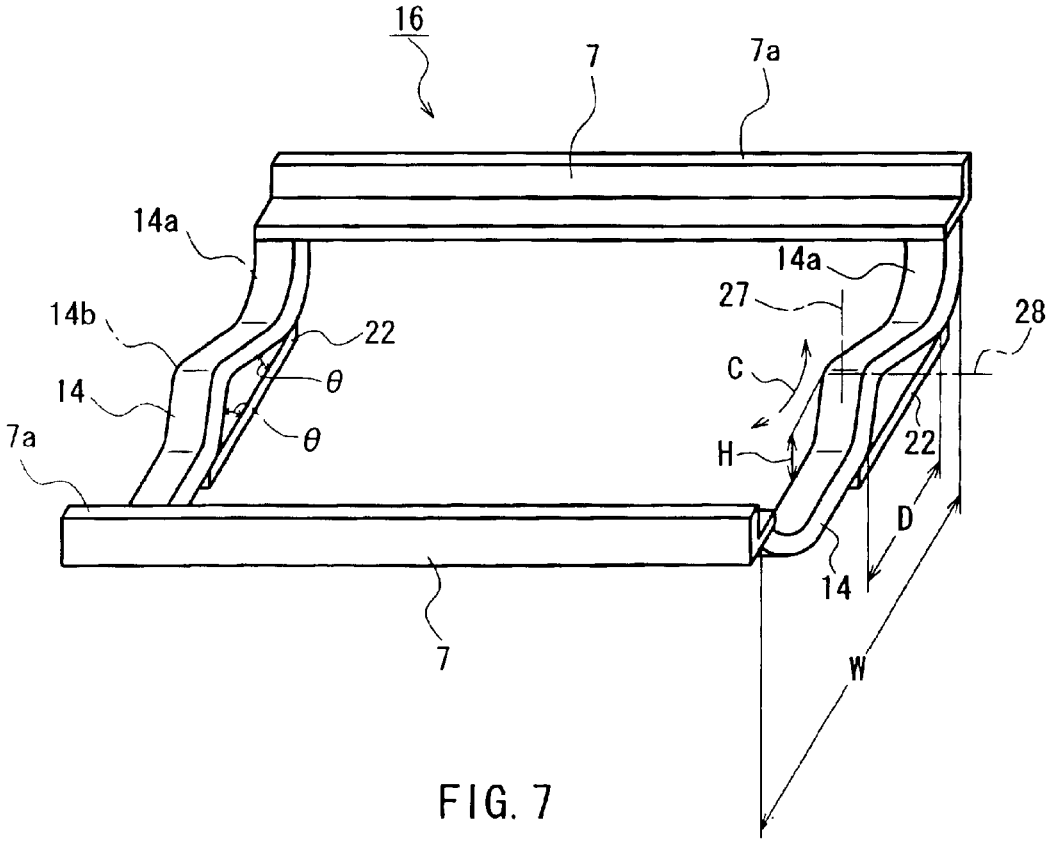
FIG. 7 is a perspective view of a shadow mask structure in a fourth embodiment of the present invention.

FIG. 7 is a perspective view to show a shadow mask structure according to a fourth embodiment. A shadow mask 6 is not shown in FIG. 6. The shadow mask structure is provided by adhering support-adjusting members 22 to the short frames 14 shown in FIG. 2. As shown in FIG. 7, support-adjusting members 22 are adhered to the short frames 14 additionally by extending across the substantially-triangular recesses in the short frames 14.

Such a structure improves the rigidity of the short frames 14 in the axial direction. Particularly, the cross-sectional second moment about a horizontal axis 28 is increased when compared to the cross-sectional second moment about the axial axis 27. Therefore, the short frames 14 have improved strength with respect to bending in the longitudinal direction. In this embodiment, the moment change is decreased as in the first to third embodiments shown in FIGS. 2, 5 and 6, and in addition to that, the rigidity of the short frames 14 is improved.

Figure 5:
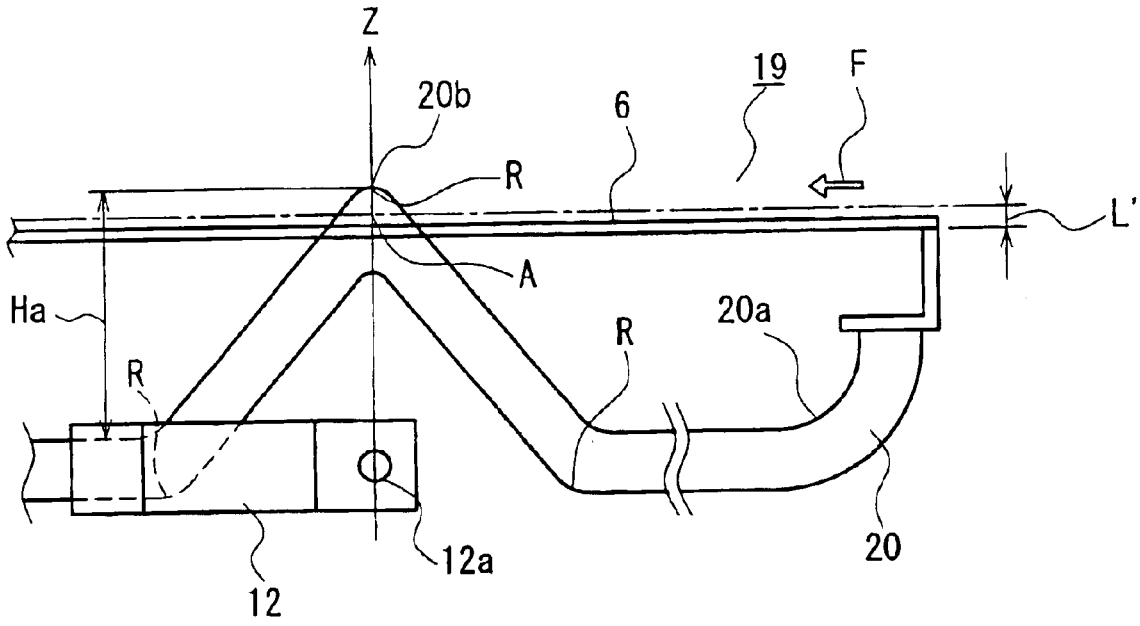
FIG. 5 illustrates a shadow mask structure in a second embodiment of the present invention, where the shadow mask structure is applied with a moment.

Therefore, when compared to the first to third embodiments shown in FIGS. 2, 5 and 6, this embodiment is further effective in suppressing displacement of the shadow mask in the axial direction, in which the displacement is caused by the change in a moment at a time of impact of electron beams. Moreover, since the improved rigidity serves to increase the cross-sectional second moment, the cross section area of the steel material used for the short frames can be decreased when the change in a moment at a time of impact of electron beams is the same.

For the frames 14, the cross-sectional second moment about the horizontal axis 28 is bigger than the cross-sectional second moment about the axial axis 27. Therefore, displacement of the short frames 14 in the axial direction (axis 27 direction) is suppressed while displacement in the horizontal direction (axis 28 direction) is increased. When the short frames 14 move outward in the horizontal direction, the short frames 14 can be displaced in the axial direction by using plate-shaped springs fixed to the short frames 14. That is, correction in the axial direction is available by using the horizontal displacement of the short frames 14.

In the fourth embodiment, the support-adjusting members 22 are made of a material having a thermal expansion coefficient higher than that of the short frames 14, so that effects in correcting unevenness in colors can be obtained. When the short frames 14 are made of a ferrous material, the support-adjusting members 22 are made of SUS 304 or the like. In this structure, under a high-temperature condition where the shadow mask is expanded by heat, each of the short frames 14 is dented as indicated with an arrow 'c' due to a difference between the short frame 14 and the support-adjusting member 22 in the thermal expansion coefficient so as to be displaced in a direction opposite to the displacement of the upper surface 7*a* of the long frame 7 in the axial direction. Thus, effects in correcting unevenness in colors can be improved. Specifically, when D/W was ⅕ and the bend angle θ at the substantial triangle was 15° in an embodiment provided with a support-adjusting member 22 as shown in FIG. 7, the movement amount of electron beams was '0 μm' at the EW end while the same movement amount was 'outwards 5 μm' at a corner. That is, the movement amount of electron beams was decreased remarkably both at the EW end and the corners when compared to the first embodiment shown in FIG. 1.

Plastic deformation of a shadow mask in a high temperature region in a production process such as frit sealing can be prevented by using support-adjusting members 22 having a thermal expansion coefficient higher than that of short frames 14. The difference in the thermal expansion coefficients will be helpful in suppressing the displacement in the axial direction at a time of operation of the cathode ray tube.

In the fourth embodiment shown in FIG. 7, high-expansive support-adjusting members 22 are fixed to the respective short frames 14 by extending across recesses formed with the substantially-triangular bent parts in the short frames 14. Alternatively, plastic deformation of the shadow mask in a high temperature region during a production process such as frit sealing can be prevented even when a support-adjusting member having a thermal expansion coefficient smaller than that of the short frame 14 is provided on a surface of the short frame 14 in the vicinity of the crest 14*b* of the substantially-triangular bent part so that the support-adjusting member is adhered firmly to the short frame 14. This configuration also is effective in suppressing displacement in the axial direction during an operation of the color cathode ray tube. Such a low-expansive support-adjusting member can be made of, for example, a 36% Ni-Fe alloy.

In each of the above embodiments, the spring members 12 are attached directly to the short frames (14, 18). Alternatively, the spring members 12 can be attached to the short frames (14, 18) through spring-attaching members similar to the aforementioned spring-attaching members 21. Notwithstanding the embodiments each describing a shadow mask structure suspended with four spring members, a shadow mask structure also can be suspended with three spring members.

Notwithstanding the embodiments where the short frames 14 are bent at which the short frames 14 are fixed to the long frames 7, linear short frames 14 can be adhered to the long frames 7. The crests (18*b*, 14*b*) at the substantially-triangular bent parts formed at the short frames (14, 18) are not limited to circular-arcs as described above, but they can be angled or trapezoidal.

The shadow mask is not necessarily fixed to the upper surfaces of a pair of long frames as long as the shadow mask is fixed to any upper portions of the long frames. For example, a shadow mask can be fixed at the end parts to sides of the long frames through the upper surface of the long frames.

As mentioned above, a color cathode ray tube according to the present invention has a pair of frames composing a shadow mask structure, and a substantially-triangular bent part is formed at each of the frames. This serves to decrease an internal moment of the shadow mask structure, and thus, displacement of the shadow mask in a direction to recede from a phosphor screen surface can be suppressed when the shadow mask is expanded by heat at a time of impact of electron beams, and consequently, color unevenness in a provided image is prevented.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed is:

1. A color cathode ray tube comprising:

a pair of long frames, a pair of opposing short frames that are fixed to the pair of long frames and support the long frames, and a shadow mask fixed to the pair of long frames in a state applied with a tensile force, wherein the short frames have substantially-triangular bent parts formed to protrude toward the shadow mask.

2. The color cathode ray tube according to claim 1, wherein neutral axes in the crests of the substantially-triangular bent parts protruding toward the shadow mask are located above a surface of the shadow mask.

3. The color cathode ray tube of the color cathode ray tube according to claim 1, wherein the substantially-triangular bent parts form recesses having a width dimension in a range from ⅙ to ½ of the maximum length in the longitudinal direction of the short frames.

4. The color cathode ray tube according to claim 1, wherein the substantially-triangular bent parts have circular corners with an outer radius of curvature of at least 15 mm.

5. The color cathode ray tube according to claim 1, further comprising support-adjusting members fixed to the short frames by extending across the recesses formed by the substantially-triangular bent parts.

6. The color cathode ray tube according to claim 5, wherein the support-adjusting members have a thermal expansion coefficient that is bigger than that of the short frames.

7. The color cathode ray tube according to claim 1, wherein the bent parts extend across the width of the short frames.

8. The color cathode ray tube according to claim 1, wherein the shadow mask is not fixed to the short frames.

* * * * *